United States Patent [19]

Iijima et al.

[11] Patent Number: 4,690,619

[45] Date of Patent: Sep. 1, 1987

[54] COMPRESSOR HAVING PULSATING REDUCING MECHANISM

[75] Inventors: Takeo Iijima; Hiroshi Nomura; Susumu Saito; Susumu Echizen, all of Konan, Japan

[73] Assignee: Diesel Kiki Co., Ltd., Tokyo, Japan

[21] Appl. No.: 837,285

[22] Filed: Mar. 6, 1986

[30] Foreign Application Priority Data

Mar. 12, 1985 [JP] Japan ..... 60-48799[U]

[51] Int. Cl.[4] ..... F04B 1/18; F04B 39/00

[52] U.S. Cl. ..... 417/269; 417/312

[58] Field of Search ..... 417/269, 312, 313

[56] References Cited

U.S. PATENT DOCUMENTS 4,290,345 9/1981 Hiraga et al. ..... 417/269 X 4,392,788 7/1983 Nakamura et al. ..... 417/269

FOREIGN PATENT DOCUMENTS 123716 9/1979 Japan ..... 417/313

*Primary Examiner*—Carlton R. Croyle

*Assistant Examiner*—Paul F. Neils

*Attorney, Agent, or Firm*—Wenderoth, Lind & Ponack

[57] ABSTRACT

A compressor of a type in which a plurality of pistons reciprocate in cylinders, the improved compressor in which a mechanism is provided to reduce pulsating of suction pressure in the cylinder head. The inside of the cylinder head is partitioned into a high pressure chamber on the side of the center and a low pressure chamber on the side of the periphery by means of bulkhead formed on the cylinder head. The low pressure chamber communicates the suction holes and the discharge opening formed on the cylinder head. The outer peripheral wall of the low pressure chamber is arranged to reduce a resistance of gas passing through the low pressure chamber as the convex portion constituting the periphery of the connecting bolt and the concave portion constituting the peripheries of the suction holes are connected by means of a connecting portion having a smooth curved surface.

4 Claims, 5 Drawing Figures

COMPRESSOR HAVING PULSATING REDUCING MECHANISM

BACKGROUND OF THE INVENTION

1. Field of the Invention

This invention relates to compressors for compressing gases such as coolant gas and the like and more particularly to compressors having a mechanism for reducing pulsating of suction pressure.

2. Prior Art

The compressors of a type in which a plurality of cylinder bores are formed in a cylinder block, and pistons are fitted in the cylinder bores, and the pistons reciprocate with a predetermined phase difference by means of oblique plates and the like, are known as wobble type and swash plate type compressors and the like. In the compressors of this kind, the pulsating of the suction pressure has heretofore been a problem. This pulsating is transmitted to an evaporator in the room interior of an automobile by means of a piping in case of a cooler of an automobile for example, and becomes a cause of generation of abnormal sound. For this reason, inventions for reducing the pulsating of the discharge pressure have heretofore been proposed.

One of the devices is described in Japanese Utility Model Laid-open Publication No. 58-199588 filed by the present applicant previously. This device is constructed in such a way that the direction of the flow of suction gas fed to a low pressure chamber in a cylinder head is changed as much as possible to reduce a pulsating of suction pressure.

However, in the foregoing conventional example, a convex portion constituting the periphery of a connecting bolt for fixing the cylinder head together with the valve plate to the cylinder block is formed on an outer peripheral wall of the cylinder head constituting the low pressure chamber and projects into low pressure chamber, and this convex portion forms a resistance to the flow of gas flowing along the outer peripheral wall of the low pressure chamber, and the velocity is remarkably different from the velocity of the gas flowing along the bulkhead in the high pressure chamber, and due to this difference in velocities, there is a problem of promoting the pulsating by a disturbance of the flow of the gas.

SUMMARY OF THE INVENTION

An object of this invention is to provide a pulsating reducing mechanism for a compressor which is capable of reducing pulsating of suction pressure by smoothing out the flow of gas passing through the low pressure chamber.

According to this invention, a compressor is provided in which a convex portion and a concave portion formed on the outer peripheral wall of a cylinder head constituting a low pressure chamber are connected by means of a connecting portion having a smooth curved surface with a shape such that it does not cause a resistance of the flow of gas passing through the low pressure chamber.

Accordingly, although the gas is sucked into the cylinder bore through each suction hole after passing through the low pressure chamber from a suction opening, the convex portion and concave portion of the outer peripheral wall constituting the low pressure chamber are connected by means of a connecting portion having a smooth curved surface, so that the suction gas passes smoothly along the outer periphery of this low pressure chamber, and for this reason, the foregoing object can be achieved.

Many other advantages, features and additional objects of this invention will become manifest to those versed in the art upon making reference to the detailed description and the accompanying drawings in which preferred structural embodiments incorporating the principles of this invention are shown by way of illustrative example.

BRIEF DESCRIPTION OF THE DRAWINGS

The drawings show an embodiment of this invention.

DETAILED DESCRIPTION

Figure 1:
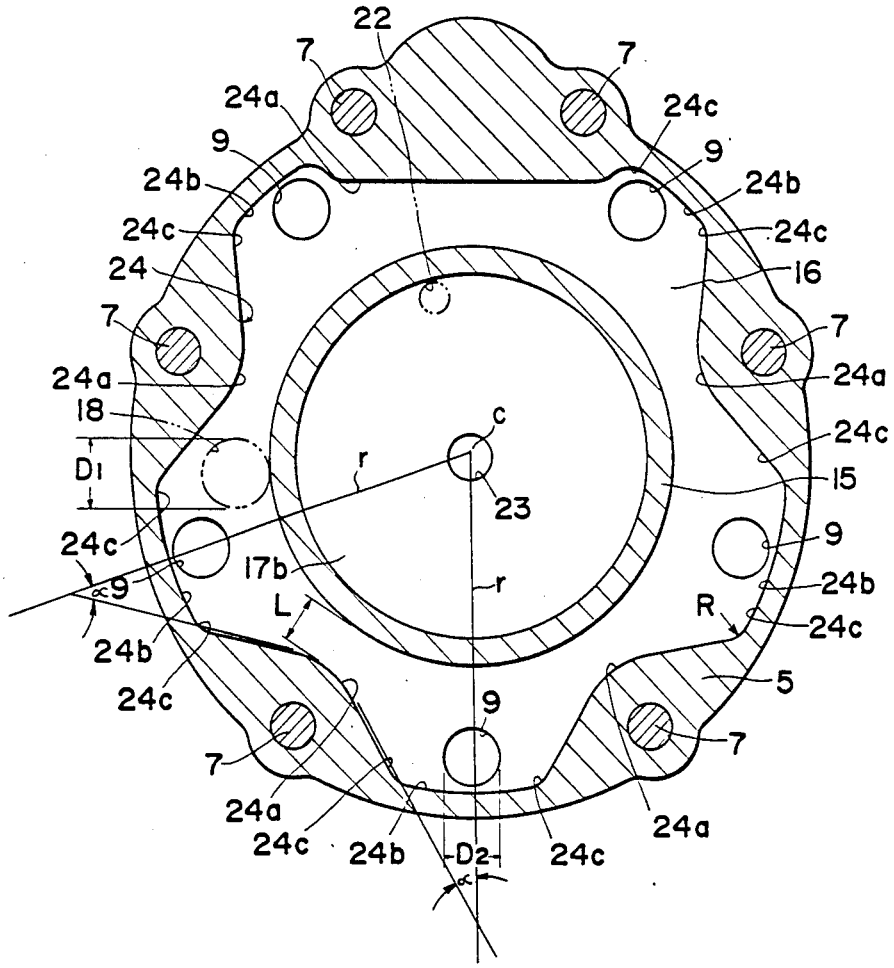
FIG. 1 is a cross section of a compressor according to the invention taken along a line I—I of FIG. 2.
Figure 2:
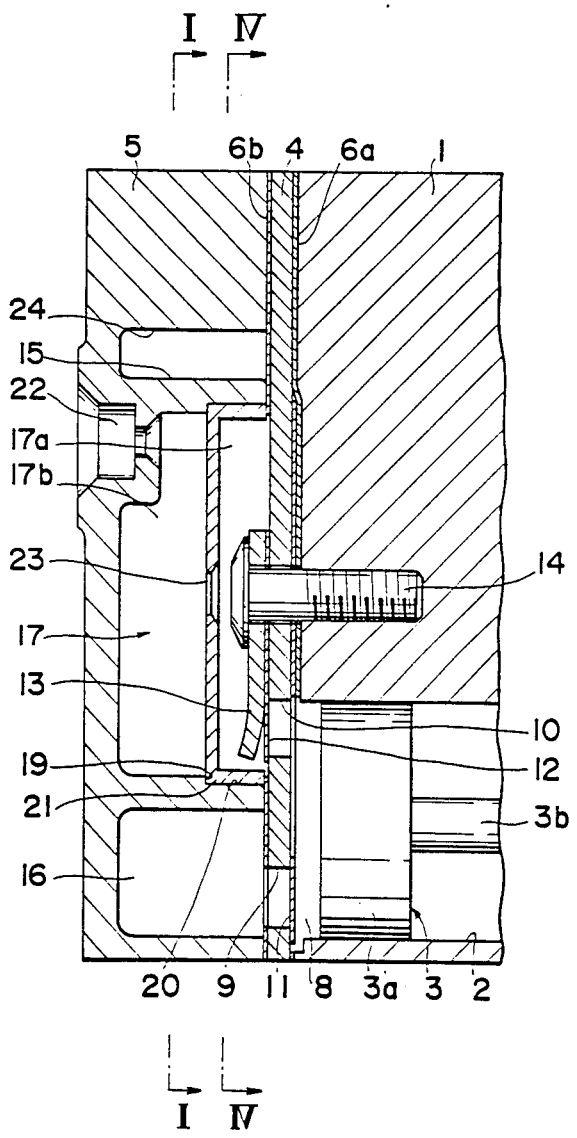
FIG. 2 is a cross section taken along a line II—II of FIG. 3.
Figure 3:
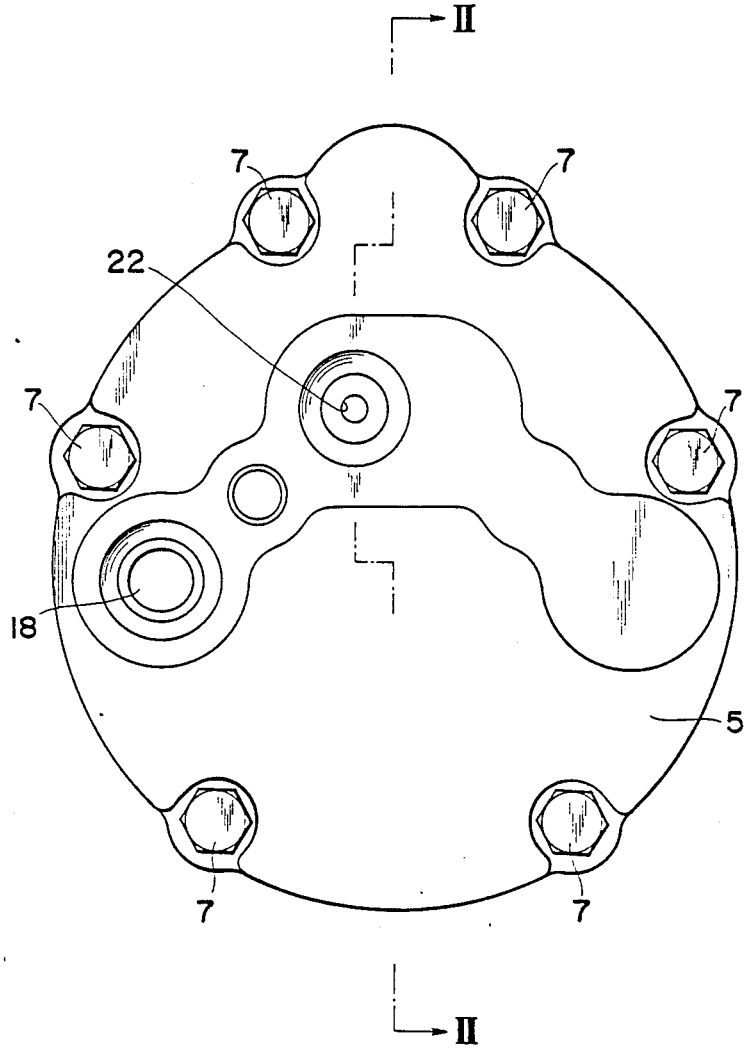
FIG. 3 is an end elevation of the compressor of FIG. 1.

In FIG. 1 through FIG. 5, an embodiment of this invention is illustrated, in which the compressor is of a well known wobble type, and, for example, five cylinder bores 2 are formed in parallel at equal circumferential intervals in a cylinder block 1, and a piston 3*a* of a piston means 3 is slidably inserted into each cylinder bore 2. The piston 3*a* is connected to a piston rod 3*b*, and the other end of the piston rod 3*b* is connected to or abuts on an oblique plate, not shown, and the adjacent pistons 3*a* reciprocate in the cylinder bores 2 with a predetermined phase difference.

A valve plate 4 and gaskets 6*a* and 6*b* on opposite sides thereof are sandwiched between the cylinder block 1 and a cylinder head 5, to be described hereinafter, and are fixed to one end of the cylinder block 1 together with the cylinder head 5 by means of a plurality of connecting bolts 7 thereby to close one end of the cylinder bores 2, and a compression chamber 8 is formed by each cylinder bore 2, the end surface of the piston 3*a* and the inner surface of the valve plate 4. This valve plate 4 is formed with suction holes 9 and discharge holes 10 at positions opposed to each cylinder bore 2, and for this reason, the number of sets of suction holes 9 and discharge holes 10 is five.

The suction holes 9 are closed by a star type suction valve 11 sandwiched between the valve plate 4 and one gasket 6*a*. This suction valve 11 is openable, and in the suction stroke in which the piston retreats and the volume of the compression chamber is enlarged, it opens the suction holes 9 to allow the gas to be sucked into the compression chamber 8 and in the compression stroke in which the piston 3 advances and the volume of the compression chamber 8 is reduced, it closes the suction holes 9. On the other hand, the discharge holes 10 are similarly closed by a star type discharge valve 12. Also, a valve stopper 13 is disposed on the back portion of this discharge valve 12, and the discharge valve 12 is fixed to the center of the cylinder block together with the valve stopper 13 by means of a mounting screw 14. This discharge valve 12 closes the discharge holes 10 in the suction stroke and opens the discharge holes 10 in the compression stroke.

The hollow cylinder head 5 has integrally formed thereon a circular bulkhead 15 centering around the mounting screw 14, and the inside of the cylinder head 5, namely, the space defined by the valve plate 4 and the cylinder head is partitioned into a low pressure chamber 16 on the outer peripheral edge and high pressure chamber 17 in the middle by means of the bulkhead 15. The low pressure chamber 16 is communicated with the suction holes 9 of the valve plate 4, and is communicated with a suction opening 18 formed in the cylinder head 5. This suction opening 18 is at a position at which it does not overlap the suction holes 9 in the axial direction of the cylinder block in the low pressure chamber 16. Also, on the inside of the bulkhead 15 of the cylinder head 5, is an enlarged diameter portion 20 having a step portion 19 at its inner end, and the outer periphery of a cup-shaped partition plate 21 of almost cylindrical shape and which has a bottom is lightly pressed into the enlarged diameter portion 20, and the high pressure chamber 17 is partitioned into a first high pressure chamber 17*a* and a second high pressure chamber 17*b*. The peripheral edge of the bottom of the partition plate 21 abuts the step portion of the cylinder head 5, and the top edge of the cylindrical sidewall thereof abuts the gasket 6*b*.

Figure 5:
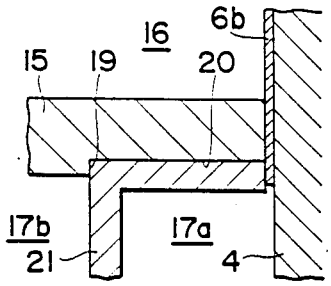
FIG. 5 is an enlarged cross section showing a seal portion between the cylinder head and the valve plate.

However, as shown in FIG. 5, the gasket 6*b* effects the main seal of this portion as the compression between the valve plate 4 and the bulkhead 15 is high, and the compression between the valve plate 4 and the partition plate 21 is small, and this portion is in the so called minus sealing area. This arrangement is provided to strengthen the seal between the low pressure chamber 16 and the second high pressure chamber 17*a* by increasing the degree of pressure contact of the valve plate 4 and the ends of the bulkhead 15, so that the minus sealing employed as the seal between the first high pressure chamber and the second high pressure chamber 17*b* is assured by lightly pressure inserting the partition plate 21.

The first high pressure chamber 17*a* surrounds the discharge valve 12, and is communicated with all the discharge holes 10. Also, the second high pressure chamber 17*b* is communicated with a discharge opening 22 formed in the cylinder head. The first high pressure chamber 17*a* and the second high pressure chamber 17*b* are communicated by means of a communicating hole 23 formed in the bottom portion of the partition plate 21.

The outer peripheral wall 24 of the cylinder head 5 constituting the outer peripheral portion of the low pressure chamber 16 is provided with an inwardly convex portion 24*a* constituting a periphery of an enlarged thickness wall section around each of the respective connecting bolts 7. This convex portion 24*a* increases the strength of the cylinder head 5 through which the connecting bolts run, and also, projects into the low pressure chamber 16 in order to minimize the portion projecting into the outer periphery of the cylinder head 5. Also, the outer peripheral wall 24 is provided with a concave portion 24*b* extending around the outer portion of the periphery of each of the suction holes 9 respectively, and the convex portions 24*a* and concave portions 24*b* are alternately formed. The convex portions 24*a* and the concave portions 24*b* are connected by means of connecting portions 24*c*, and the connecting portion 24*c* has a smooth curved surface with a curvature having all points at an inwardly acute angle $\alpha$ to the radii r through the adjacent suction holes 9 and the central axis c of said cylinder block, such that they do not cause a resistance to the flow of gas passing through the low pressure chamber 16. In this Embodiment, the radius of curvature R (shown in FIG. 1) of the connecting portion 24*c* is set at above 10 mm.

Also, assuming that the diameter of the suction opening 18 is $D_1$, and the diameter of each suction opening 9 is $D_2$, and the distance from the (tip of the convex portion 24*a*) to the bulkhead 15 is L, the relationship of $D_1 > L > D_2$ is established.

Figure 4:
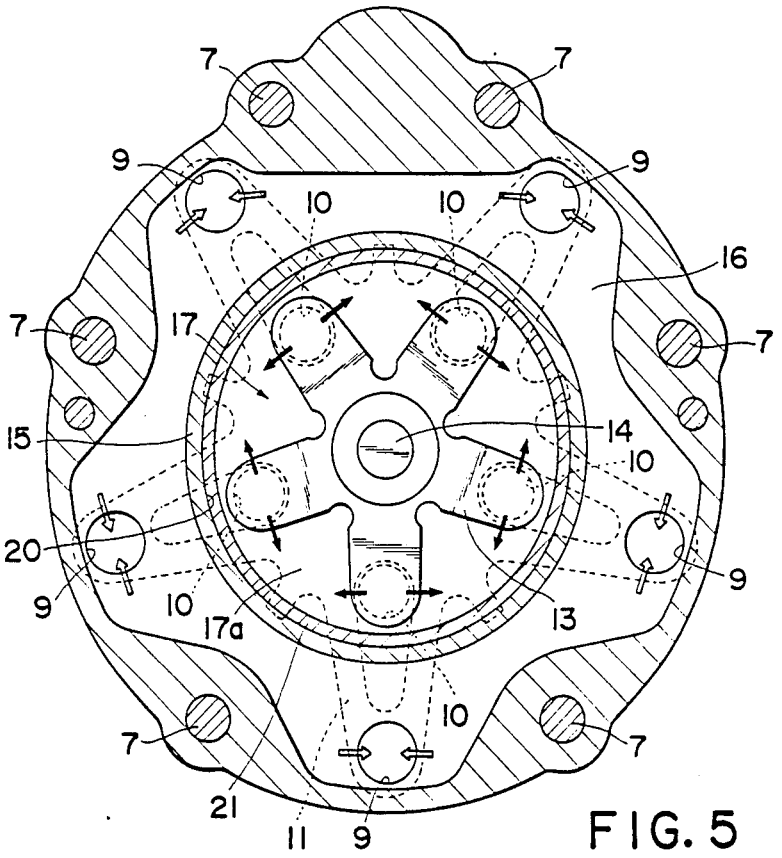
FIG. 4 is a cross section taken along a line IV—IV of FIG. 2.

Next, the operation of this Embodiment will be described in the following. In FIG. 4, the arrow mark of white-on-black shows the flow of suction gas and the arrow mark of black-on-white shows the flow discharge gas respectively.

When a drive shaft, not shown, is rotated, each piston 3*a* reciprocates in the corresponding cylinder bore 2 at a phase difference of 72 degrees with respect to the adjacent pistons. When each piston 3*a* starts the suction stroke, the volume of the compression chamber 8 is enlarged so that the pressure in the compression chamber 8 is lowered, opening the suction valve 11 to suck the gas into the compression chamber 8, and the suction gas from the suction piping (not shown) enters the low pressure chamber 16 through the suction opening 18.

In this case, if there is an overlapping portion of the suction opening 18 and suction holes 9 in the axial direction, the gas flowing through the overlapped portion has a greater velocity than that of the gas flowing to the other portions, thereby to promote the pulsating. However, in this Embodiment, since the suction opening 18 is formed at a non-overlapping position, this can be prevented.

The suction gas entering through the suction opening 18 is sucked into the compression chamber 8 through the suction holes 9 after passing through the low pressure chamber but, in this case, in the low pressure chamber 16, since the bulkhead is of circular shape, the flow of suction gas flowing along the bulkhead 15 is smooth, and on the other hand, the convex portion 24*a* and the concave portion 24*b* of the outer peripheral wall 24 are connected by means of the connecting portion 24*c* formed of the smooth curved surface so that the flow of suction gas flowing along this outer peripheral wall 24 is smooth, and resistance flow or reflection of the suction gas does not occur. Accordingly, the flow of all suction gas flowing in the low pressure chamber 16 is smooth, and the promotion of the pulsating can be prevented. Also, the suction gas constricted at the suction opening 18 is released upon entering the flow pressure chamber 16, and the gas is constricted when passing between the bulkhead 15 and the convex portion 24*a* of the outer peripheral wall 24, other than the part of the gas sucked into the cylinder bores 2 through the suction holes 9 positioned in the vicinity of the suction opening 18, and is released again in the space between the bulkhead 15 and the concave portion 24*b*, and furthermore, is constricted when passing through suction holes 9, and is released again in the compression chamber 8. Accordingly, the pulsating of suction pressure produced by the suction with a predetermined phase difference becomes gradually smaller by repeating the constriction and release of the suction gas and by passing through the curved path from opening 18 to the holes 9. Particularly, in this Embodiment, as described in the foregoing, when $D_1 > L > D_2$ is set, the pulsating can be more attenuated.

When the discharge gas opens the discharge valve 12 as the volume of the compression chamber 8 is reduced, it is discharged to the first high pressure chamber 17*a* through the discharge holes 10 upon reaching high pressure, and is stored temporarily in the first high pressure chamber 17*a*, and then, is discharged out of the compressor through the discharge opening 22 upon passing through the second high pressure chamber 17*b* by means of the communicating hole 23.

Obviously, many modifications and variations of the present invention are possible in the light of above teachings. It is therefore to be understood that within the scope of the appended claims, the invention may be practiced otherwise than as specifically described.

What is claimed is:

1. A compressor having a pulsating reducing means, said compressor comprising:

a cylinder block having a plurality of cylinder bores therein;

a plurality of pistons slidable in said cylinder bores;

means connected to said pistons for driving said pistons with a predetermined phase difference between the strokes of the respective pistons;

a valve plate on one end of said cylinder block and having a plurality of sets of at least one suction hole and at least one discharge hole, one set being positioned over the end of each of said cylinder bores;

a suction valve in each suction hole for opening and closing said suction hole;

a discharge valve in each discharge hole for opening and closing said discharge hole;

a hollow cylinder head on said one end of said cylinder block over said valve plate, said cylinder head having an end wall and a depending peripheral wall; and a plurality of connecting bolts fixing the cylinder head and the valve plate to said cylinder block;

said cylinder head having a peripheral wall depending from an end wall and a bulkhead within said peripheral wall also depending from said end wall for partitioning the interior of said cylinder head into a high pressure chamber in the center of the interior and a low pressure chamber around the periphery of the interior, said end wall having a suction opening and a discharge opening therein, said high pressure chamber having said discharge holes opening thereinto and said discharge opening opening out therefrom, said low pressure chamber having said suction holes opening out therefrom and having said suction opening opening thereinto, and the inner surface of the peripheral wall of said cylinder head forming the outer wall of said low pressure chamber having a plurality of enlarged thickness sections around the respective connecting bolts, each of said sections having an inwardly convex surface portion, and said inner surface having a plurality of concave portions extending around the outer portions of the peripheries of said suction holes, and said inner surface having smoothly curved connecting portions connecting said convex portions and said concave portions, all points of which connecting portions are at an inwardly acute angle to a radius through the adjacent suction holes and the central axis of said cylinder block, whereby they do not form resistances to flows of gas passing through said low pressure chamber, said suction holes and said suction opening extending in the axial direction of said cylinder block and being in non-overlapping relation in said axial direction.

2. A compressor according to claim 1 in which said bulkhead is of circular shape.

3. A compressor according to claim 1 in which the diameter $D_1$ of said suction opening, the diameter $D_2$ of said suction holes and the shortest distance L between said bulkhead of said low pressure chamber and said outer peripheral wall are in the relationship $D_1 > L > D_2$.

4. A compressor according to claim 1 in which said suction holes and said suction opening in said low pressure chamber are in a non-overlapping laterally offset position relative to the axis of said cylinder block.

* * * * *